US007565928B2

(12) United States Patent
Lynde et al.

(10) Patent No.: US 7,565,928 B2
(45) **Date of Patent: *Jul. 28, 2009**

(54) DOWNHOLE ABRADING TOOL HAVING A TAGGANT INJECTION ASSEMBLY FOR INDICATING EXCESSIVE WEAR

(75) Inventors: Gerald Lynde, Houston, TX (US); Darrin L. Willauer, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 306 days.

This patent is subject to a terminal disclaimer.

(21) Appl. No.: 11/496,663

(22) Filed: Jul. 31, 2006

(65) Prior Publication Data

US 2008/0000691 A1 Jan. 3, 2008

(51) Int. Cl.
*E21B 49/00* (2006.01)

(52) U.S. Cl. ..... 166/250.12; 175/39; 175/42; 175/374

(58) Field of Classification Search ..... 175/39, 175/42, 374; 166/250.12
See application file for complete search history.

(56) References Cited

U.S. PATENT DOCUMENTS

| | | | | |
|---|---|---|---|---|
| 2,457,960 A | | 1/1949 | Walker | |
| 2,461,164 A | * | 2/1949 | Lewis | 175/39 |
| 2,468,905 A | | 5/1949 | Warren | |
| 2,560,328 A | | 7/1951 | Bielstein | |
| 2,585,312 A | * | 1/1952 | Del Homme | 175/39 |
| 2,657,909 A | | 11/1953 | Bielsten | |
| 3,011,566 A | * | 12/1961 | Graham | 175/39 |
| 3,062,302 A | | 11/1962 | Toth et al. | |
| 3,155,176 A | * | 11/1964 | Bennett | 175/42 |
| 3,678,883 A | * | 7/1972 | Fischer | 116/208 |
| 3,853,184 A | | 12/1974 | McCullough | |
| 3,865,736 A | | 2/1975 | Fries | |
| 4,655,300 A | | 4/1987 | Davis, Jr. et al. | |

(Continued)

FOREIGN PATENT DOCUMENTS

GB 658323 A 10/1951

(Continued)

OTHER PUBLICATIONS

Notification of Transmittal of the International Search Report and the Written Opinion of the International Searching Authority, Or the Declaration, Nov. 13, 2007, pp. 1-2, PCT/US2007/071926, European Patent Office.

(Continued)

*Primary Examiner*—Jennifer H Gay
*Assistant Examiner*—Nicole A Coy
(74) *Attorney, Agent, or Firm*—Greenberg Traurig LLP; Anthony F. Matheny

(57) ABSTRACT

A downhole abrading tools has a body with a first end for connection with a rotating component of a drill string and a cutting end for rotation in unison with the body. The downhole abrading tool also includes a passage through the tool for circulating a drilling fluid. Disposed within the drilling fluid passageway is a taggant injection assembly having one or more taggants disposed therein that facilitates injection of taggants into the drilling fluid upon the cutting end experience excessive wear. The taggants are then transported to the surface location along with the drilling fluid for detection by the operator of the downhole abrading tool.

25 Claims, 6 Drawing Sheets

U.S. PATENT DOCUMENTS

| | | | |
|---|---|---|---|
| 4,785,895 | A | 11/1988 | Davis et al. |
| 4,818,153 | A | 4/1989 | Strandell et al. |
| 2006/0099885 | A1 | 5/2006 | Lynde et al. |
| 2007/0209802 | A1 | 9/2007 | Xu et al. |

FOREIGN PATENT DOCUMENTS

| | | | |
|---|---|---|---|
| GB | 1276311 | A | 6/1972 |
| WO | WO2005/113926 | A | 12/2005 |

OTHER PUBLICATIONS

International Search Report, Nov. 13, 2007, pp. 1-3, PCT/US2007/071926, European Patent Office.

Written Opinion of the International Searching Authority, Nov. 13, 2007, pp. 1-5, PCT/US2007/071926, European Patent Office.

Notification of Transmittal of the International Search Report and the Written Opinion of the International Searching Authority, Or the Declaration, Jan. 8, 2008, pp. 1-2, PCT/US2007/071935, European Patent Office.

International Search Report, Jan. 8, 2008, pp. 1-7, PCT/US2007/071935, European Patent Office.

Written Opinion of the International Searching Authority, Jan. 8, 2008, pp. 1-9, PCT/US2007/071935, European Patent Office.

Office Action dated Feb. 12, 2008 in U.S. Appl. No. 11/479,231, U.S. Patent and Trademark Office.

Office Action dated Feb. 19, 2008 in U.S. Appl. No. 11/479,606, U.S. Patent and Trademark Office.

* cited by examiner

DOWNHOLE ABRADING TOOL HAVING A TAGGANT INJECTION ASSEMBLY FOR INDICATING EXCESSIVE WEAR

BACKGROUND

1. Field of Invention

The invention is directed to downhole abrading tools utilized in oil and gas wells to abrade objects within the well and, in particular, to downhole mills that are used to abrade, among other objects, stuck tools, bridge plugs, well tubing, and well casing disposed within the well.

2. Description of Art

In the drilling, completion, and workover of oil and gas wells, it is common to perform work downhole in the well bore with a tool which has some sort of wearable working profile interfacing with a downhole structure. Examples would be milling a downhole metal object with a milling tool, performing a washover operation with a rotary shoe, cutting through a tubular with a cutting or milling tool, or drilling through formation with a drill bit. During the performance of these operations, it is common for the working profile of the tool, such as the cutting elements mounted on its lower or outer face, to wear away. As this wear progresses, the effectiveness of the tool decreases.

It is desirable to pull the tool from the well and replace it when the working profile has experienced a given amount of wear. The degree of wear at which it is desirable to replace the tool depends upon the type of tool and the operation being performed. Unfortunately, it is difficult or even impossible for the well operator at the surface of the well to know accurately when this given amount of wear has occurred. Often, the decision as to when to pull the tool depends substantially upon the experience of the operator. That is, the operator must estimate the amount of tool wear based on whatever is known about the time the operation has been underway, the weight on the tool, the type of downhole structure being worked, the cuttings found in the drilling fluid, or a gradual change in work string torque or rate of penetration. None of these parameters provides a definitive indication that the wear in the working profile has progressed to a specific degree at which the operator desires to pull the tool from the well. Pulling a tool prematurely adds unnecessary trips out of the well, adding to rig time and increased costs. Pulling the tool too late gradually decreases the effectiveness of the downhole operation, also adding to rig time and increasing the cost of the operation.

Accordingly, downhole abrading tools and methods of indicating to an operator of a downhole abrading tool of excessive wear on a cutting end of the downhole abrading tool have been desired in the art. As discussed herein, the present downhole abrading tools and methods of indicating to an operator of a downhole abrading tool of excessive wear on the cutting end of a downhole abrading tool effectively and efficiently identify excessive wear on the downhole abrading tool. Therefore, the operator of the downhole abrading tool is informed of when the downhole abrading tool should be removed from the well and replaced.

SUMMARY OF INVENTION

Broadly, the invention is directed to downhole abrading tools utilized in cutting or abrading objects disposed within the well. The term "object" encompasses any physical structure that may be disposed within a well, for example, another tool that is stuck within the well, a bridge plug, the well tubing or the well casing.

The downhole abrading tools of the invention include a taggant injection assembly having a taggant disposed therein. The taggant injection assembly is in fluid communication with an indicator chamber disposed in the cutting end of the downhole abrading tool. When the indicator chamber is exposed to the well environment due to excessive wear on the cutting end of the tool, the taggant contained within the taggant injection assembly is released from the taggant injection assembly into the well. In so doing, the taggant injection assembly forces the taggant out of the end of the downhole abrading tool by using the pressure from the drilling fluid flowing through the tool. The taggant is then transported by the drilling fluid to the surface of the well where it can then be detected by the operator of the tool. Thus, the taggants, when observed by the operator, indicate to the operator that the tool has experienced excessive wear and should be replaced.

In accordance with the invention, the foregoing advantages have been achieved through the present downhole abrading tool for use in a well. The downhole abrading tool comprises a tool body having a first end for connection with a rotating component of a drill string, and a cutting end, the cutting end having an abrading matrix containing an abrasive material for rotating engagement with an object within the well, the abrading matrix having a wear-away chamber disposed therein; a drilling fluid passageway through the tool for circulating a drilling fluid into the well; a housing releasably secured in the drilling fluid passageway, the housing having a cavity with at least one taggant contained therein, the cavity being in fluid communication with the wear-away chamber; and a piston slidably disposed in the cavity, the piston being in fluid communication with the drilling fluid passageway and isolating the drilling fluid passageway from the cavity, so that when excessive wear exposes the wear-away chamber to the drilling the fluid in the well, the drilling fluid in the drilling fluid passageway pushes the piston downward, forcing at least one of the at least one taggants out of the cavity and through the wear-away chamber into the well.

Alternately, the barrier may be a collapsible bladder disposed in the cavity, the collapsible bladder containing the at least one taggant and being in fluid communication with the drilling fluid passageway and isolating the drilling fluid from the taggants contained therein. An additional feature of the downhole abrading tool is that the cavity may be isolated from the drilling fluid passageway by the barrier and the wear-away chamber is in fluid communication with the drilling fluid passageway through a first passageway disposed axially with respect to an axis of the cavity and a second passageway and a third passageway, each disposed circumferentially with respect to the axis of the cavity.

The drilling fluid passageway further may include a bypass portion extending alongside the housing. The bypass portion may comprise at least one drilling fluid channel formed integral as part of the housing. A cap may be located within the cavity above the piston for retaining the piston in the cavity, the retainer cap having a hole therethrough that exposes the piston to the drilling fluid in the drilling fluid passageway. A retainer may be releasably secured to the tool body in the drilling fluid passageway to retain the housing in the drilling fluid passageway. A communication passage may extend from the wear-away chamber to the drilling fluid passageway, wherein the housing has a lower portion that sealingly stabs into the communication passage. A check valve may be disposed in the lower end of the housing, the check valve closing when the housing is removed from the tool body to block the flow of the at least one taggant out of the cavity, the check valve opening when the housing is installed in the tool body. The check valve may comprise a stem that extends into contact with the wear-away chamber to open the check valve when the housing is installed within the drilling fluid passageway. The taggants may be selected from the group consisting of a colored dye, a radio-frequency tag, a radioactive material, a florescent material, a microscopic encoded tag, and mixtures thereof. One of the taggants may comprise a pellet, the pellet comprising an outer shell encasing a core, the outer shell being dissolvable in the drilling fluid, and the core being an expandable material. The abrading matrix may include at least one taggant embedded within the abrading matrix below the wear-away chamber and capable of being released by the abrading matrix into the downhole location due to wear on the abrasive material prior to release of the taggant from the cavity.

In accordance with the invention, the foregoing advantages also have been achieved through the present method of injecting at least one taggant into a well to indicate excessive wear to a downhole abrading tool. The method comprises the steps of: (a) providing a downhole abrading tool comprising a tool body having a first end for connection with a rotating component of a drill string, and a cutting end, the cutting end having a wear-away chamber disposed therein, and a drilling fluid passageway through the tool for circulating a drilling fluid into the well; (b) inserting a housing into the drilling fluid passageway, the housing having a cavity with at least one taggant contained therein, and a piston slidably disposed in the cavity, the piston being in fluid communication with the drilling fluid passageway and isolating the drilling fluid passageway from the cavity, the cavity being placed in fluid communication with the wear-away chamber such that at least one of the at least one taggants is permitted to flow from the cavity into the wear-away chamber; (c) securing the housing in the drilling fluid passageway; (d) connecting the first end of the body to a drill string and lowering the drill string into the well until the cutting end contacts an object disposed within the well; (e) abrading the object for a sufficient amount of time until the wear-away chamber is exposed to the well; and (f) injecting at least one of the taggants into the well by the drilling fluid pushing the piston downward, causing at least one of the taggants to flow from the cavity and through the wear-away chamber into the well, such that at least one of the taggants is transported to a surface location of the well along with the drilling fluid to indicate excessive wear to the downhole abrading tool.

A further feature of the method is that the downhole abrading tool may further comprise a check valve having a head and a stem, the check valve being disposed in a lower end of the housing, the check valve having a closed position when the housing is removed from the drilling fluid passageway to block the flow of the at least one taggant out of the cavity and the check valve having an opened position when the housing is installed in the drilling fluid passageway; and during step (b), the check valve is moved from the closed position to the opened position by contacting the stem of the check valve with the wear-away chamber. Another feature of the method is that the method may further comprise the steps of: (g) removing the downhole abrading tool from the well after step (f); (h) disconnecting the downhole abrading tool from the drill string; and (i) removing the housing from the drilling fluid passageway, wherein during the removal of the housing, the check valve is moved from the opened position to the closed position by ceasing contact of the stem with the wear-away chamber.

The downhole abrading tools and methods of abrading an object in a well have the advantages of providing effective and efficient identification of excessive wear on the downhole abrading tool.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
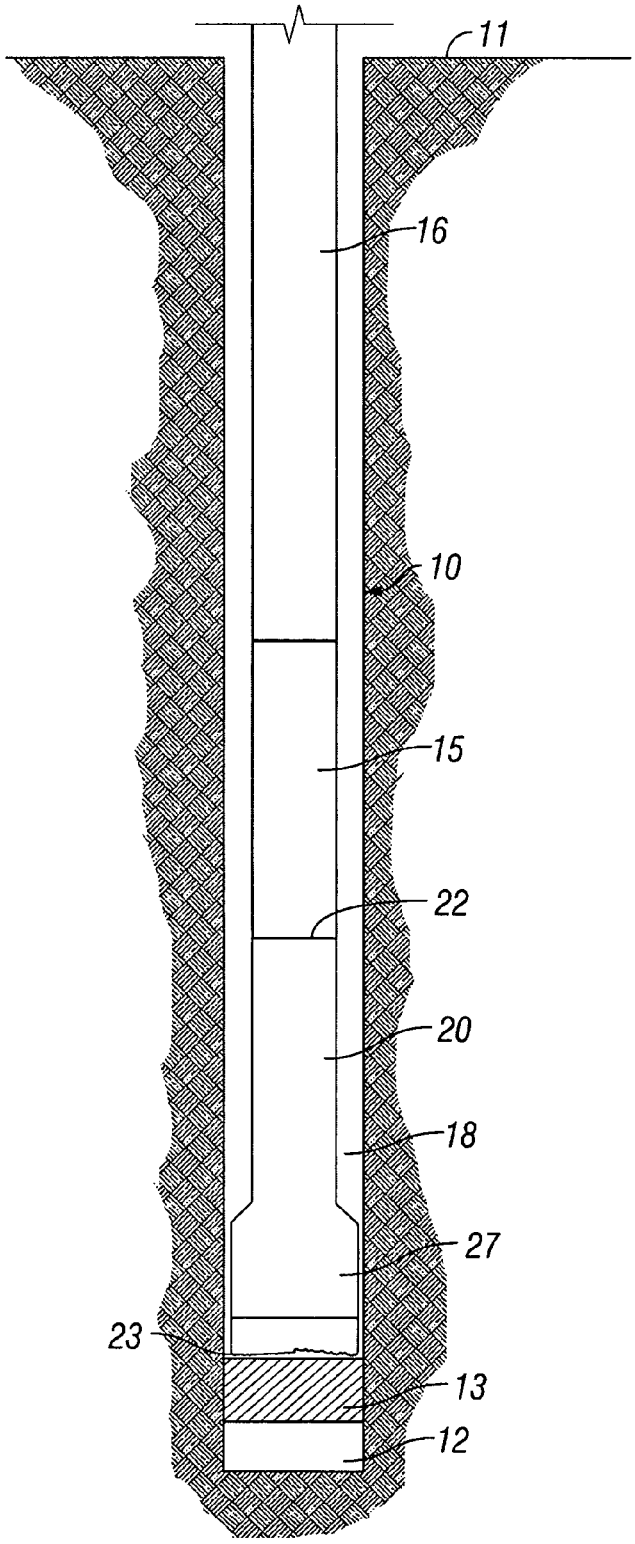
FIG. 1 is across-sectional view of an oil or gas well having a specific embodiment of a downhole abrading tool of the present invention disposed therein.

Referring to FIG. 1, oil and gas wells 10 have a surface location 11 and a downhole location 12. Object 13 is disposed within well 10. Downhole abrading tool, or mill, 20 is connected to rotating component 15 which, together with downhole abrading tool 20, is part of drill string 16. Rotating component 15 could be a downhole drill motor. Alternatively, the entire drill string 16 rotates. Tool 20 has first end 22 and cutting end 23. Downhole abrading tool 20 is placed in contact with object 13 and then rotated, using equipment known to persons skilled in the art, to abrade object 13.

Figure 2:
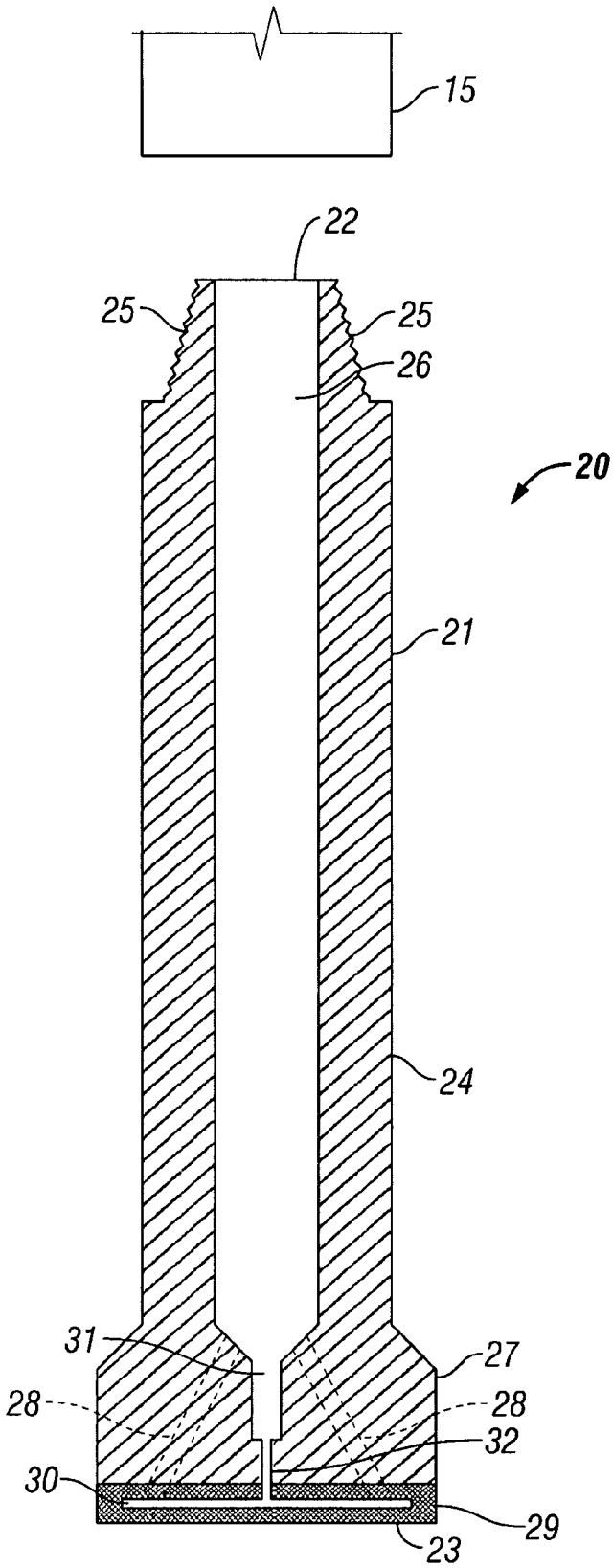
FIG. 2 is a cross-sectional view of a downhole abrading tool of the present invention shown without the taggant injection assembly installed.
Figure 3:
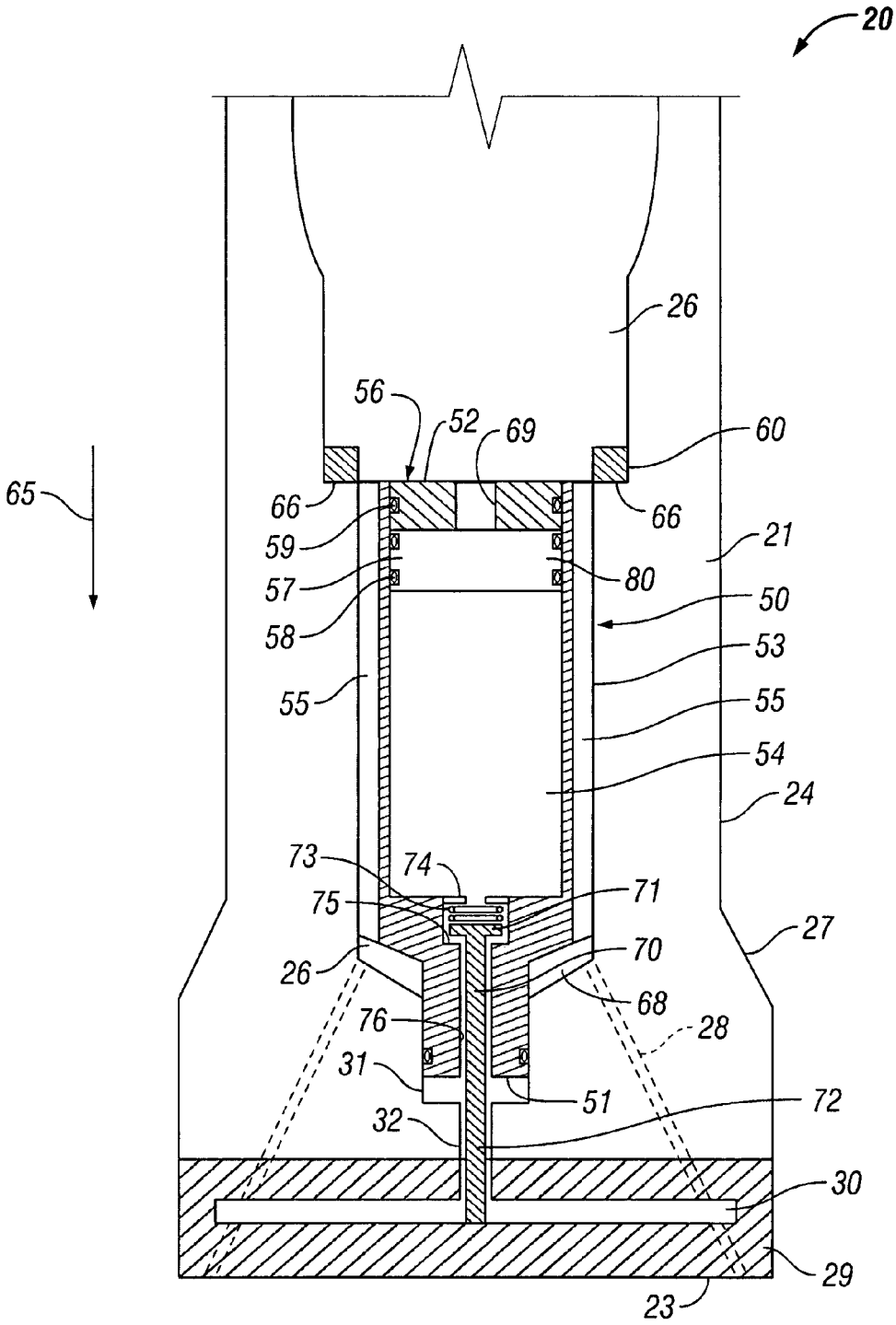
FIG. 3 is a partial cross-sectional view of the downhole abrading tool shown in FIG. 2 having a taggant injection assembly installed therein.
Figure 4:
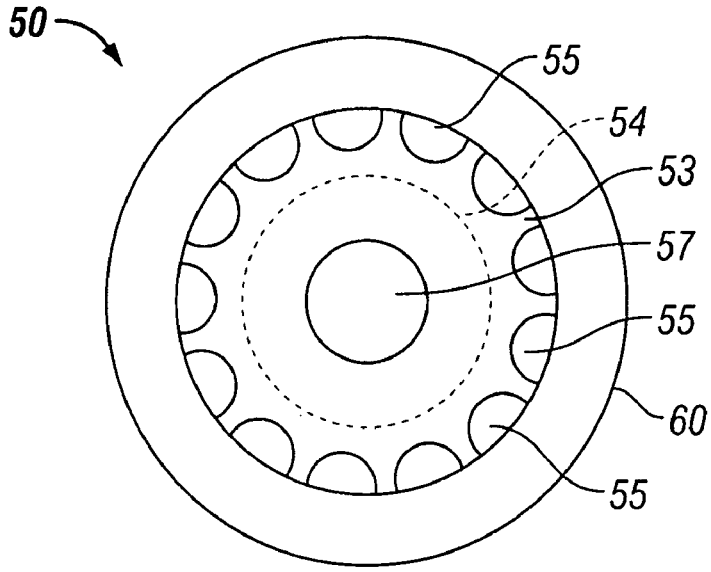
FIG. 4 is a top view of the downhole abrading tool shown in FIG. 3.

As illustrated in FIGS. 2-4, downhole abrading tool 20 includes body 21, having first end 22, cutting end 23, exterior surface 24, drilling fluid passageway 26, and head 27. First end 22 is adapted to be connected to rotating component 15 or drill string 16 to facilitate rotation of downhole abrading tool 20. First end 22 preferably includes threads 25 to facilitate attachment to rotating component 15 or drill string 16. Passage 26 is disposed longitudinally within body 21 to permit drilling fluid to flow through downhole abrading tool 20. Accordingly, drilling fluid (not shown) flows from equipment (not shown) located at surface 11, through drill string 16, through passage 26, and through drilling fluid outlets 28 (shown in dashed lines) into well environment 18 and back up to the surface location 11. The drilling fluid facilitates cutting by downhole abrading tool 20.

Cutting end 23 includes abrading matrix 29 formed of an abrading material, such as hardfacing or other cutting material known in the art. Disposed within abrading matrix 29 is wear-away chamber 30, which is in fluid communication with a reduced diameter passage 31 extending upward within body 21. Preferably, passage 31 includes a lower smaller diameter portion 32 in direct fluid communication with wear-away chamber 30. The upper end of passage 31 joins drilling fluid passageway 26, which is of larger diameter. Wear-away chamber 30 is a sealed chamber located within cutting end 23. Wear-away chamber 30 is isolated by taggant injection assembly 50 (FIG. 3) from the pressure of the drilling fluid while still within drilling fluid passageway 26, and is also isolated from the wellbore fluid pressure. The wellbore fluid pressure comprises the discharge pressure at outlet 28 and the hydrostatic fluid pressure in the wellbore.

As illustrated in FIGS. 3-4, taggant injection assembly 50 is disposed within drilling fluid passageway 26. Taggant injection assembly 50 includes housing 53 with lower end 51, upper end 52, and internal cavity 54. Vertical flutes or channels 55 (shown also in FIG. 4) are formed on the exterior of housing 53. Channels 55 permit drilling fluid (not shown) to flow from drilling fluid passageway 26 along the length of taggant injection assembly 50 to outlets 28, which are at the lower end of drilling fluid passageway 26. Lower end 51 of housing 53 inserts sealingly into passage 31, blocking flow from channels 55 into passage 31. Alternatively, channels 55 could be eliminated and replaced with an annular passage surrounding the outer diameter of housing 53.

Barrier 80, such as piston 57, is slidably disposed in cavity 54 by seals 58. Cap 56 is sealingly secured in upper end 52 of cavity 54 to retain piston 57. Cap 56 may be secured in a variety of manners to housing 53 and may have seal 59 that seals to the inner diameter of cavity 54. In one embodiment, a pair of roll pins (not shown) extends through cap 56 and housing 53 perpendicular to the axis to retain cap 56. The entire taggant injection assembly 50 is retained in body 21 by a retaining ring 60, such as by threads (not shown). In this embodiment, retaining ring 60 engages threads in drilling fluid passageway 26 and bears against an inward facing shoulder 66. Retaining ring 60 does not block flow through channels 55. Cap 56 has an axial passage 69 that communicates drilling fluid pressure to piston 57.

Taggant injection assembly 50 and drilling fluid passageway 26 preferably have substantially reciprocal shapes to facilitate reception of taggant injection assembly 50. In one specific embodiment, gap 68 within drilling fluid passageway 26 is formed between the lower portion of housing 53 and the bottom of drilling fluid passageway 26 to allow flow from channels 55 to outlets 28.

At least one taggant (not shown in FIG. 3) is carried within cavity 54. Each taggant may be, for example, a colored dye, a radio-frequency tag, a radioactive material, a florescent material, a microscopic encoded tag such as those used in explosive materials and can be obtained from Microtrace Inc. located in Minneapolis, Minn., or a pellet having an outer shell that is dissolvable in the drilling fluid encasing a core formed of an expandable material such as a cellular polystyrene such as Styrofoam®. When released from taggant injection assembly 50, each taggant provides an indication to an operator of downhole abrading tool 20 that the tool 20 has experienced excessive wear.

In one embodiment, check valve 70 is disposed within lower end 51 of taggant injection assembly 50. Although check valves are known in the art, and any such check valve may be disposed within in lower end 51, certain general components of check valve 70 are further described herein.

Check valve 70 includes head 71 and stem 72 that extends through a passage 76 in the bottom of housing 53. Head 71 moves between upper and lower positions and seals against seat 75 while in the lower position (not shown). Check valve 70 also includes coil spring 73 and spring retainer 74 so that coil spring 73 urges head 71 downward against seat 75. In its initial position (not shown) prior to taggant injection assembly 50 being installed in body 21, head 71 engages seat 75 and blocks or prevents the taggants from flowing from cavity 54.

After taggant injection assembly 50 is installed within drilling fluid passageway 26, stem 72 contacts the bottom of wear-away chamber 30 and is forced upward. As a result, head 71 is also forced upward from seat 75, permitting the taggants to flow from cavity 54, through passage 76, into passage 31 and, thus, into wear-away chamber 30.

In operation, wear-away chamber 30 is initially filled with taggants and sealed from the wellbore. Drilling fluid flows down drilling fluid passageway 26, channels 55, and outlets 28. When downhole abrading tool 20 experiences excessive wear, wear-away chamber 30 is exposed to well environment 18 and, thus, taggants flow into the wellbore, assisted by the downward movement of piston 57. Taggants are then released from cavity 54 into well environment 18 and are mixed with the drilling fluid exiting outlets 28. As the drilling fluid circulates up well 10 to surface location 1, it carries with it each of the released taggants. Upon reaching surface location 11, taggants are detected by an operator of the downhole abrading tool 20, either visually, or using equipment designed specifically for the detection of taggants. Identification of taggants by the operator provides an indication that downhole abrading tool 20 has experienced excessive wear. Subsequent to the operator detecting the released taggants, the operator can decide to remove downhole abrading tool 20 from well 10 to replace downhole abrading tool 20.

In this embodiment, piston 57 facilitates the release of taggants from cavity 54 after wear-away chamber 30 is exposed to well environment 18. Prior to wear-away chamber 30 being exposed to well environment 18, the taggants disposed in cavity 54 are unable to be flow from cavity 54. As a result, the pressure being exerted downward (arrow 65) by the drilling fluid flowing through drilling fluid passageway 26, i.e., the drilling fluid pressure, is unable to move piston 57. Subsequent to cutting end 23 experiencing excessive wear and, thus, exposing wear-away chamber 30 to well environment 18, cavity 54 is also exposed to well environment 18. Because the pressure within well environment 18, i.e., the wellbore pressure, is less than the pressure being exerted downward (arrow 65) on piston 57 by the drilling fluid, the drilling fluid pressure forces piston 57 downward in direction of arrow 65 and, thus, forces the taggants from cavity 54, through passage 31, into wear-away chamber 30, and into well environment 18 so that the taggants can be carried to surface 11 by the drilling fluid for detection by the operator. Usually, piston 57 will move all the way to the bottom of cavity 54.

When downhole abrading tool 20 is removed from well 10 to be replaced, taggant injection assembly 50 can be removed from drilling fluid passageway 26, and check valve 70 will prevent additional release of residual taggants remaining within cavity 54. After removal, cavity 54 can be refilled with additional taggants and taggant injection assembly 50 can be reused by being installed into a new or repaired downhole abrading tool 20. Accordingly, cost savings are realized because taggants are not lost due to spillage, no clean-up of spilled taggants is required, and taggant injection assembly 50 is reusable.

Figure 5:
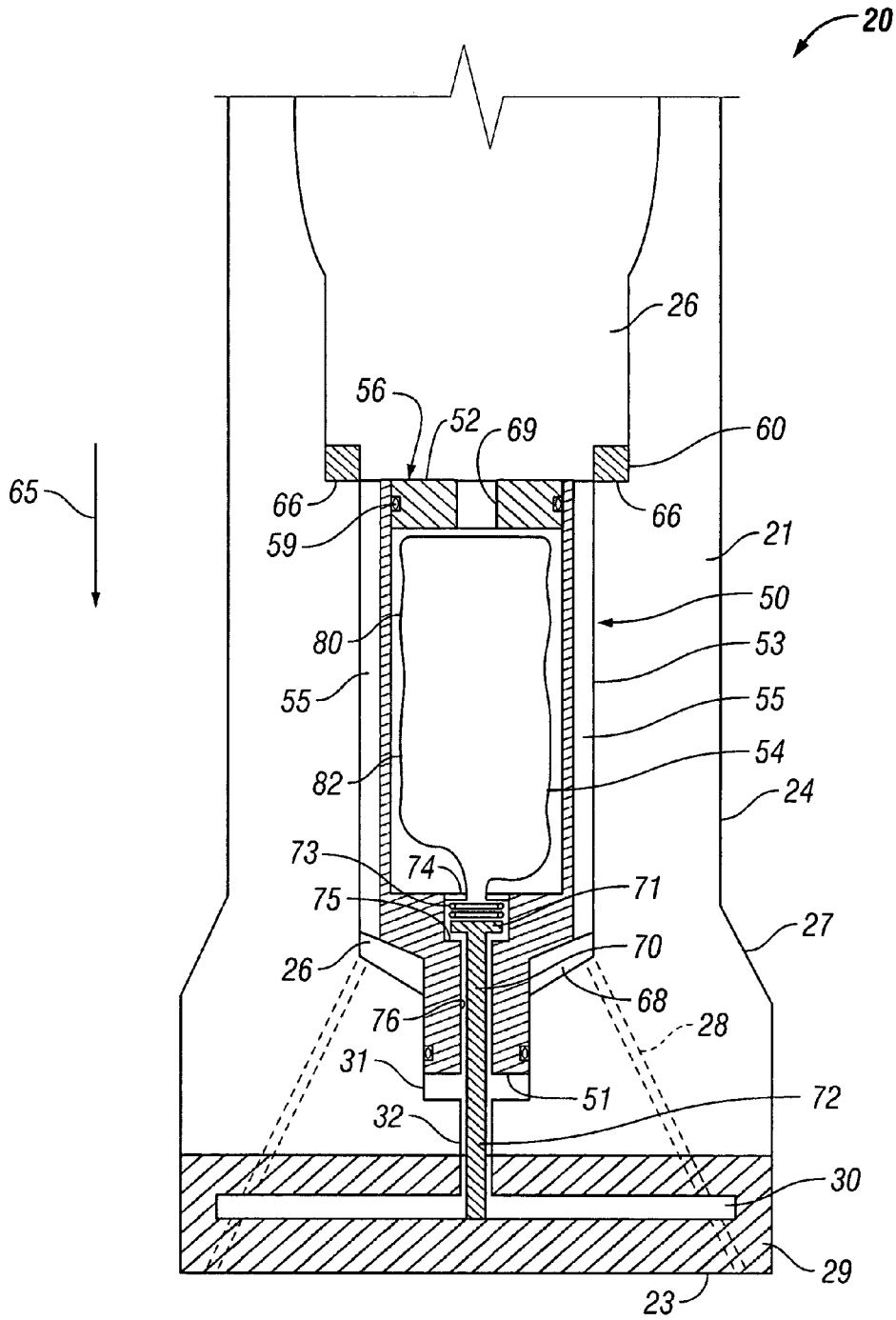
FIG. 5 is a partial cross-sectional view of another specific embodiment of the downhole abrading tool having a taggant injection assembly installed therein.

Referring now to FIG. 5, barrier 80 may be collapsible bladder 82 which contains the taggants. Collapsible bladder 82 forces the taggants out from taggant injection assembly 50 when drilling fluid flows through axial passage 69 of cap 56 and wear-away chamber 30 is exposed to the wellbore pressure. A piston, such as piston 57 (not shown in FIG. 5) may also be included with collapsible bladder 82 to facilitate injection of the taggants from collapsible bladder 82.

Figure 6:
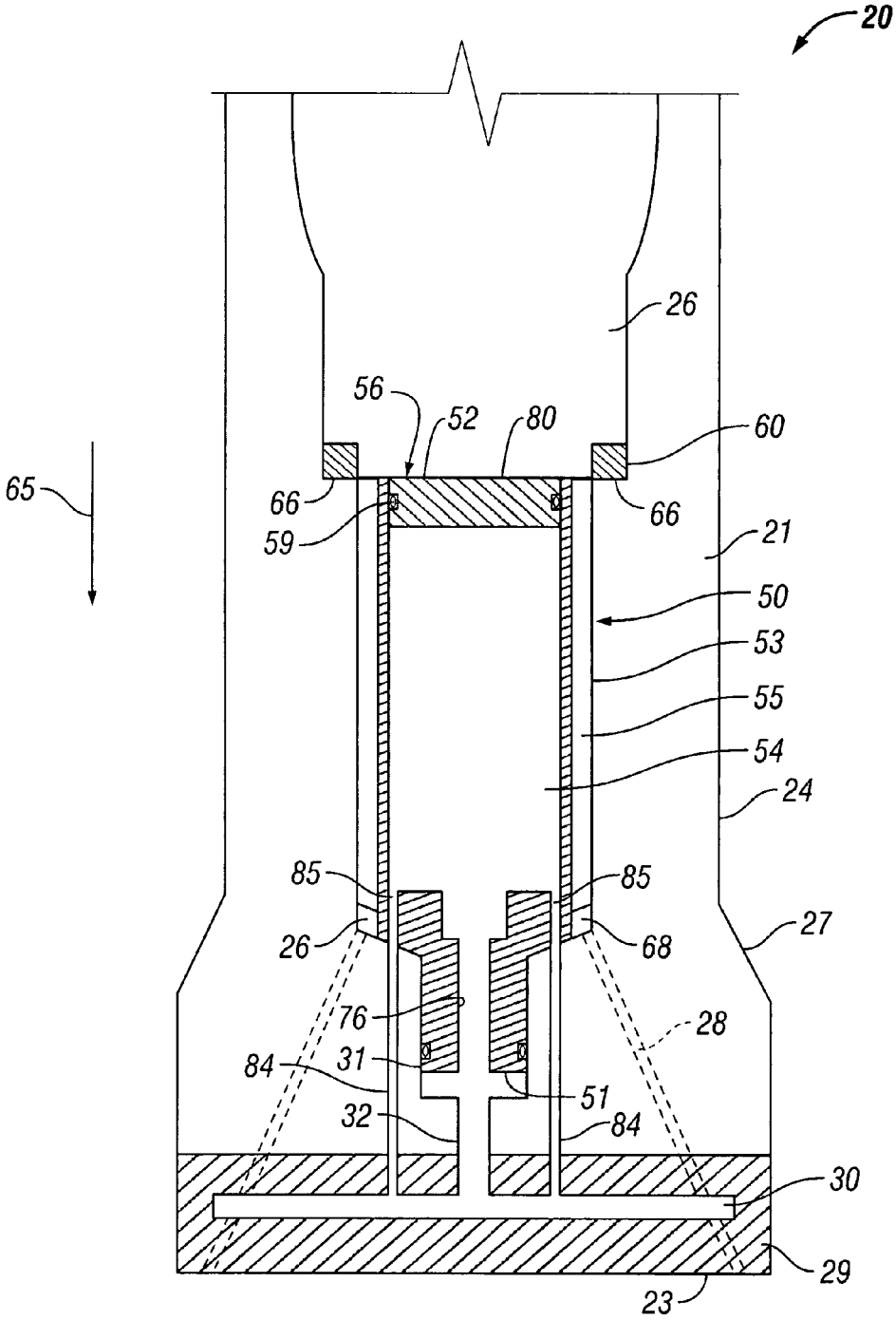
FIG. 6 is a partial cross-sectional view of still another specific embodiment of the downhole abrading tool having a taggant injection assembly installed therein.

As illustrated in FIG. 6, in another embodiment, barrier 80 is stationarily fixed in the upper end of cavity 54 isolating cavity 54 from drilling fluid passageway 26 and drilling fluid passageway 26 includes at least two additional passages 84 in fluid communication with wear-away chamber 30. As will be recognized by persons of ordinary skill in the art, this embodiment does not require barrier 80 to move to facilitate injection of the taggants. Instead, the two additional passages 84 are offset with respect to the axis of cavity 54, while passage 32 is disposed co-axially with respect to the axis of cavity 54. Passages 84 extend through head 27 and register with outlets 85 formed in the lower end of housing 53. Outlets 85 join cavity 54 near its outer diameter and are spaced 180 degrees apart from each other around the circumference of housing 53. Outlets 85 and passages 84 are parallel to the axis of cavity 54 in this example, but could be angled. A seal (not shown) seals the junction of each passage 84 with one of the outlets 85.

This embodiment injects taggants into the well environment by using centrifugal forces created by rotating head 27 and, thus, taggant injection assembly 50. Due to the centrifugal forces, taggants gravitate to the inner walls of cavity 54 above outlets 85 and passages 84. When wear-away chamber 30 is exposed to well environment 18, drilling fluid from the wellbore is transported up passages 31 and 76 into the center of cavity 54. Cavity 54 is isolated from drilling fluid pressure in passageway 26 because of barrier 80, which is fixed to housing 53 in this embodiment. As a result, the drilling fluid from the wellbore flows into cavity 54 and forces the taggants disposed along the inner walls of cavity 54 down through outlets 85 and passages 84 and into well environment 18.

Alternatively, a one-way poppet (not shown) may be installed through barrier 80 that permits drilling fluid to pass through barrier 80 to facilitate movement of the taggants down through outlet 85 and passages 84 into well environment 18.

When wear-away chamber 30 is breached, passages 84 are also exposed to drilling fluid pressure from exterior of head 27. The centrifugal force due to rotation of head 27 prevents upward flow of drilling fluid through passages 84 and outlets 85. Unless check valves are employed in outlets 85, there would be no need for a check valve, such as check valve 70 (FIG. 3) As will be recognized by persons of ordinary skill in the art, barrier 80 in this embodiment could be cap 56 in which cap 56 lacks axially passage 69.

A spring in connection with a piston may also be used in connection with the embodiment shown in FIG. 6. In this embodiment, a spring (not shown) is disposed between barrier 80, which is closed and fixed, and piston 57 (FIG. 3, not shown in FIG. 6). Because wear-away chamber 30 is closed, there is no outlet for taggants, thus piston 57 cannot move downward. When wear-away chamber 30 is breached, the spring expands, pushing piston 57 downward to assist injection of the taggants from the cavity through holes 85 and passages 84.

Figure 7:
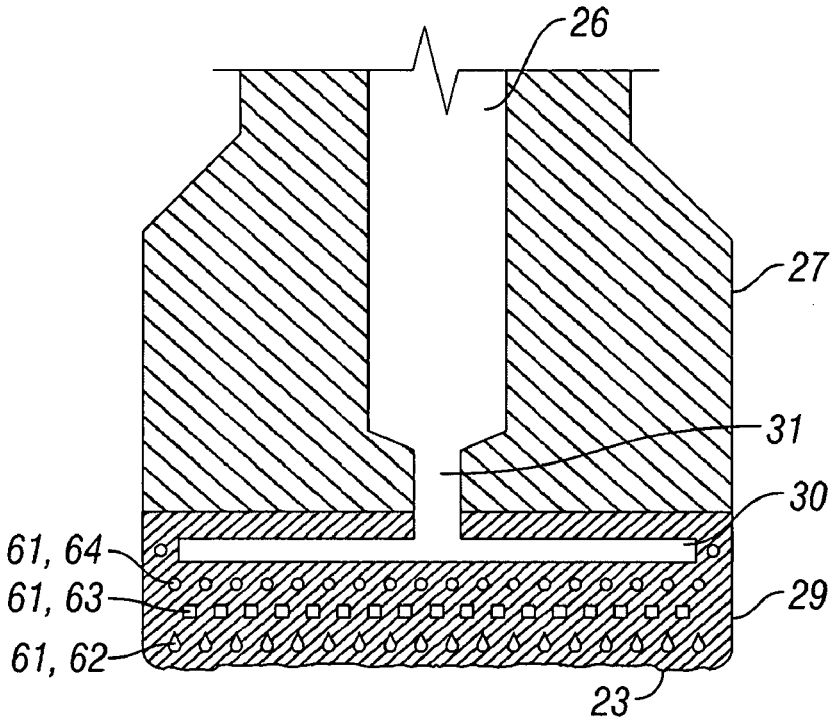
FIG. 7 is a partial cross-sectional view of another specific embodiment of a downhole abrading tool of the present invention.

Referring now to FIG. 7, in another specific embodiment, abrading matrix 29 also includes one or more taggants 61 disposed or embedded therein. As abrading matrix 29 is worn away due to excessive wear on cutting end 23 of downhole abrading tool 20, one or more taggant 61 is released from abrading matrix 29 into well environment 18 and, thus, into the drilling fluid. The release occurs prior to wear-away chamber 30 being breached. As the drilling fluid circulates up well 10 to surface location 11, it carries with it each of the released taggants 61. Upon reaching surface location 11, taggants 61 are detected by an operator of the downhole abrading tool 20, either visually, or using equipment designed specifically for the detection of taggant 61. Identification of taggants 61 by the operator provides an indication that downhole abrading tool 20 has experienced a certain amount of wear, although not excessive wear such that downhole abrading tool 20 must be replaced. In this manner, the operator can be advised as to incremental amount of wear of cutting end 23.

In a preferred aspect of this embodiment, taggants 61 may be formed integral with the abrading material that forms abrading matrix 29. In other words, in this embodiment, taggants 61 are embedded or disposed within abrading matrix 29 during the formation of abrading matrix 29.

In another preferred aspect of this embodiment, shown in FIG. 7, different taggants 61 are disposed at different locations within abrading matrix 29, thereby providing different indications as to the extent of wear on cutting end 23. For example, taggants 62 are released prior to taggants 63, and taggants 63 are released prior to taggants 64. Accordingly, an operator is provided with incremental indication as to the wear on cutting end 23. Alternatively, taggants 62, 63, and 64 can be disposed in specific areas of abrading matrix 29, e.g., taggants 62 on the sides, taggants 63 on the bottom, and taggants 64 in the middle so that an indication can be made as to the specific area or region of cutting end 23 undergoing wear. Accordingly, the operator of downhole abrading tool 20 will be advised of additional information regarding the location and degree of wear occurring on cutting end 23.

Various combinations of the different types of taggants 61 can be used to better educate the operator as to the location of the excessive wear on cutting end 23 as well as the degree of wear occurring at various locations of cutting end 23. For example, taggants 61 having colored dyes may be released if excessive wear occurs on the outer portions of abrading matrix 29, and taggants 61 having radio-frequency tags may be released if excessive wear occurs on the center portion of abrading matrix 29.

As will be understood by persons skilled in the art, downhole abrading tool 20 may abrade objects in numerous different ways utilizing numerous different structurally designed heads 27 and abrading matrixes 29. For example, downhole abrading tool 20 can include one or more abrading blades having one or more wear-away chambers 30 disposed therein. Additionally, more than one taggant injection assembly may be positioned in the drilling fluid passageway, each in communication with a different wear-away chamber, each different wear-away chamber being disposed within the abrading matrix at varying distances from cutting end 23. In this embodiment, each taggant injection assembly includes a different taggant, thereby permitting incremental wear of the cutting end to be monitored.

In another embodiment, referring to FIG. 3, barrier 80 may be actuated or assisted through the use of a spring (not shown) disposed above the barrier. When wear-away chamber 30 is breached, the spring pushes piston 57 downward, thereby injecting the taggants out through passage 76. In this instance, axial passage 69 in cap 56 is not required. Instead, the breaching of wear-away chamber 30 creates a sufficient release of upward pressure on the springs to permit the springs to expand and force barrier 80 downward, causing taggants to be injected into the wellbore.

In still another embodiment, barrier 80 may be a pump disposed within cavity 54. When wear-away chamber is breached, drilling fluid from drilling fluid passageway 26 and taggants from cavity 54 are propelled through the pump and out of wear-away chamber 30 into well environment 18.

Therefore, it is to be understood that the invention is not limited to the exact details of construction, operation, exact materials, or embodiments shown and described, as modifications and equivalents will be apparent to one skilled in the art. Accordingly, the invention is therefore to be limited only by the scope of the appended claims.

What is claimed is:

1. A downhole abrading tool for use in a well, the downhole abrading tool comprising:

a tool body having a first end for connection with a rotating component of a drill string, and a cutting end, the cutting end having an abrading matrix containing an abrasive material for rotating engagement with an object within the well, the abrading matrix having a wear-away chamber disposed therein;

a drilling fluid passageway through the tool for circulating a drilling fluid into the well; and a removable housing disposed in the drilling fluid passageway, the removable housing having a lower portion, a cavity with at least one taggant contained therein, and a valve disposed in the lower portion, the valve having a closed position when the housing is removed from the drilling fluid passageway and an opened position when the housing is disposed within the drilling fluid passageway, the cavity being in fluid communication with the wear-away chamber through the valve when the valve is in the opened position, so that when excessive wear exposes the wear-away chamber to the drilling fluid in the well, the taggant flows out of the cavity and through the wear-away chamber into the well.

2. The downhole abrading tool of claim 1, further comprising:

a barrier in fluid communication with the drilling fluid passageway and isolating the drilling fluid from the taggant contained in the cavity of the housing, the barrier being movable relative to the housing; and wherein exposure of the wear-away chamber to the drilling fluid in the well causes the barrier to force the taggant from the cavity in response to the pressure of the drilling fluid in the drilling fluid passageway.

3. The downhole abrading tool of claim 2, wherein the barrier comprises a collapsible bladder disposed in the cavity, the collapsible bladder containing the taggant and being in fluid communication with the drilling fluid passageway and isolating the drilling fluid from the taggant contained therein.

4. The downhole abrading tool of claim 2, wherein the barrier comprises a piston slidably disposed in the cavity, the piston being in fluid communication with the drilling fluid passageway and isolating the drilling fluid passageway from the cavity.

5. The downhole abrading tool of claim 4, further comprising:

a cap within the cavity above the piston for retaining the piston in the cavity, the retainer cap having a hole therethrough that exposes the piston to the drilling fluid in the drilling fluid passageway.

6. The downhole abrading tool of claim 1, wherein the cavity in the housing is isolated from the drilling fluid passageway by a barrier, and the wear-away chamber is in fluid communication with the cavity in the housing through a first passageway disposed co-axially with respect to an axis of the cavity for receiving drilling fluid from the well when the wear-away chamber is breached, and a plurality of passageways that join the cavity at points offset from the axis of the cavity for causing centrifugal force due to rotation of the tool to force the taggant from the cavity when the wear-away chamber is breached.

7. The downhole abrading tool of claim 1, wherein the drilling fluid passageway further includes a bypass portion extending alongside the housing.

8. The downhole abrading tool of claim 7, wherein the bypass portion comprises at least one drilling fluid channel formed integral as part of the housing.

9. The downhole abrading tool of claim 1, further comprising a retainer releasably secured to the tool body in the drilling fluid passageway to retain the housing in the drilling fluid passageway.

10. The downhole abrading tool of claim 1, further comprising:

a communication passage extending from the wear-away chamber to the drilling fluid passageway, wherein the housing has a lower portion that seals to the communication passage.

11. The downhole abrading tool of claim 1, wherein the valve is a check valve.

12. The downhole abrading tool of claim 11, wherein the check valve comprises:

a stem that extends into contact with the wear-away chamber to open the check valve when the housing is installed within the drilling fluid passageway.

13. The downhole abrading tool of claim 1, wherein the at least one taggant is selected from the group consisting of a colored dye, a radio-frequency tag, a radioactive material, a florescent material, a microscopic encoded tag, and mixtures thereof.

14. The downhole abrading tool of claim 1, wherein the at least one taggant comprises a pellet, the pellet comprising an outer shell encasing a core, the outer shell being dissolvable in the drilling fluid, and the core being an expandable material.

15. A downhole abrading tool for use in a well, the downhole abrading tool comprising:

a body for connection to a drill string and having a head that rotates in unison with the body against an object in the well, the head having a sealed wear-away chamber disposed therein;

a drilling fluid passageway extending on a longitudinal axis of the body and having a lower end that joins at least one outlet extending through the head at an angle relative to the longitudinal axis;

a communication port extending from the wear-away chamber to the lower end of the drilling fluid passageway;

a housing disposed within the drilling fluid passageway, the housing comprising a cavity containing at least one taggant, the housing having a lower portion that seals to the communication port, the housing having an injector port in the lower portion; and a piston slidably engaged with the cavity, the piston having an upper side exposed to the drilling fluid passageway to facilitate injection of the taggant upon exposure of the wear-away chamber to a wellbore pressure.

16. The downhole abrading tool of claim 15, wherein the drilling fluid passageway further includes a bypass portion extending alongside the housing and leading to the outlet of the drilling fluid passageway.

17. The downhole abrading tool of claim 16, wherein the bypass portion comprises at least one drilling fluid channel formed integral as part of the housing.

18. The downhole abrading tool of claim 15, further comprising a retainer releasably secured to the tool body in the drilling fluid passageway to retain the housing in the drilling fluid passageway.

19. The downhole abrading tool of claim 15, further comprising:

a check valve disposed in the lower end of the housing, the check valve closing when the housing is removed from the tool body to block the flow of the taggant out of the cavity, the check valve opening when the housing is installed in the tool body.

20. The downhole abrading tool of claim 19, wherein the check valve comprises:

a stem that extends into contact with the wear-away chamber to open the check valve when the housing is installed within the drilling fluid passageway.

21. A method of injecting at least one taggant into a well to indicate excessive wear to a downhole abrading tool, the method comprising the steps of:

(a) providing a the downhole abrading tool comprising:

a tool body having a first end for connection with a rotating component of a drill string, and a cutting end, the cutting end having a wear-away chamber disposed therein, and a drilling fluid passageway through the tool for circulating a drilling fluid into the well;

(b) placing at least one taggant in a cavity of a removable housing, the housing having a lower portion and a valve disposed in the lower portion, the valve having a closed position when the housing is removed from the drilling fluid passageway and an opened position when the housing is disposed within the drilling fluid passageway, the cavity being in fluid communication with the wear-away chamber through the valve when the valve is in the opened position;

(c) securing the housing in the drilling fluid passageway, isolating the portion of the cavity containing the taggant from the drilling fluid passageway, and communicating the cavity with the wear-away chamber by placing the valve in the opened position;

(d) connecting the first end of the body to a drill string and lowering the drill string into the well until the cutting end contacts an object disposed within the well;

(e) pumping drilling fluid through the drill string and the tool and abrading the object for a sufficient amount of time until the wear-away chamber is exposed to the well; and (f) in response to the wear-away chamber being exposed to drilling fluid pressure in the wellbore, causing the taggant to flow from the cavity and through the wear-away chamber into the well, such that the taggant is transported to a surface location of the well along with the drilling fluid to indicate excessive wear to the downhole abrading tool.

22. The method according to claim 21, wherein:

step (b) comprises placing a piston within the cavity;

step (e) comprises exposing the piston to pressure of the drilling fluid in the drilling fluid passageway; and step (f) comprises moving the piston downward.

23. The method of claim 21, wherein the downhole abrading tool further comprises a check valve having a head and a stem, the check valve being disposed in a lower end of the housing, the check valve having a closed position when the housing is removed from the drilling fluid passageway to block the flow of the taggant out of the cavity, and the check valve having an opened position when the housing is installed in the drilling fluid passageway; and during step (c), the check valve is moved from the closed position to the opened position by contacting the stem of the check valve with the wear-away chamber.

24. The method of claim 23, further comprising the steps of:

(g) removing the downhole abrading tool from the well after step (f);

(h) disconnecting the downhole abrading tool from the drill string; and (i) removing the housing from the drilling fluid passageway, wherein during the removal of the housing, the check valve is moved from the opened position to the closed position by ceasing contact of the stem with the wear-away chamber.

25. The method according to claim 21, wherein:

step (b) comprises providing the housing with a plurality of outlets spaced around a circumference of the housing;

step (c) comprises communicating the outlets with the wear-away chamber; and step (f) comprises forcing the taggant through the outlets in response to centrifugal force due to rotation of the tool.

* * * * *